United States Patent [19]

Banerjee et al.

[11] Patent Number: 4,858,630

[45] Date of Patent: Aug. 22, 1989

[54] SMOKING ARTICLE WITH IMPROVED AEROSOL FORMING SUBSTRATE

[75] Inventors: Chandra K. Banerjee, Pfafftown; Gary R. Shelar, Greensboro, both of N.C.

[73] Assignee: R. J. Reynolds Tobacco Company, Winston-Salem, N.C.

[21] Appl. No.: 939,203

[22] Filed: Dec. 8, 1986

[51] Int. Cl.[4] ..... A24B 15/16; A24D 1/18

[52] U.S. Cl. ..... 131/364; 131/370; 131/335

[58] Field of Search ..... 131/369, 359, 370–375, 131/335

[56] References Cited

U.S. PATENT DOCUMENTS

| | | |
|---|---|---|
| 2,907,686 | 10/1959 | Siegel . |
| 3,258,015 | 6/1966 | Ellis et al. . |
| 3,316,919 | 2/1967 | Green et al. . |
| 3,356,094 | 12/1957 | Ellis et al. . |
| 3,516,417 | 6/1970 | Moses . |
| 3,943,941 | 3/1976 | Boyd et al. . |
| 4,044,777 | 8/1977 | Boyd et al. . |
| 4,079,742 | 3/1978 | Rainer et al. . |
| 4,284,089 | 8/1981 | Ray . |
| 4,286,604 | 9/1981 | Ehretsmann et al. . |
| 4,326,544 | 4/1982 | Hardwick et al. . |
| 4,340,072 | 7/1982 | Bolt et al. . |
| 4,347,855 | 9/1982 | Lanzillotti . |
| 4,391,285 | 0/0000 | Burnett . |
| 4,474,191 | 10/1984 | Steiner . |

FOREIGN PATENT DOCUMENTS

| | | |
|---|---|---|
| 117355 | 9/1984 | European Pat. Off. . |
| 0174645 | 3/1986 | European Pat. Off. . |
| 1398538/3890 | 9/1985 | Liberia . |

OTHER PUBLICATIONS

Tobacco Substitutes, Noyes Data (1976).
Ames et al., Mut. Res., 31:347–364 (1975).
Nagao et al., Mut. Res. 42:335 (1977).

*Primary Examiner*—V. Millin
*Attorney, Agent, or Firm*—Grover M. Myers; David G. Conlin

[57] ABSTRACT

The present invention relates to an aerosol producing substrate for subsequent use in smoking articles and to methods of preparing the aerosol producing substrate. Preferred smoking articles which employ the aerosol producing substrate of the present invention are capable of producing substantial quantities of aerosol, both initially and over the useful life of the product, without significant thermal degradation of the aerosol former and without the present of substantial pyrolysis or incomplete combustion products or sidestream aerosol. Thus, such smoking articles provide the user with the sensations and benefits of cigarette smoking without burning tobacco.

72 Claims, 1 Drawing Sheet

SMOKING ARTICLE WITH IMPROVED AEROSOL FORMING SUBSTRATE

BACKGROUND OF THE INVENTION

The present invention relates to an aerosol producing substrate material for use with a smoking article and in particular to a porous carrier material having substantially absorbed within its pores a tobacco flavor material and a non-aqueous, non-tobacco aerosol forming material. The present invention also relates to methods of preparing the aerosol producing substrate and, in particular, to a one-step and two-step approach. Such substrate materials are especially useful in making smoking articles that produce an aerosol resembling tobacco smoke, but which contain no more than a minimal amount of incomplete combustion or pyrolysis products.

Cigarette-like smoking articles have been proposed for many years, especially during the last 20 to 30 years. See for example, U.S. Pat. Nos, 4,079,742 to Rainer et al; 4,284,089 to Ray; 2,907,686 to Siegel; 3,258,015 and 3,356,094 to Ellis et al.; 3,516,417 to Moses; 3,943,941 and 4,044,777 to Boyd et al.; 4,286,604 to Ehretsmann et al.; 4,326,544 to Hardwick et al.; 4,340,072 to Bolt et al.; 4,391,285 to Burnett; 4,474, 191 to Steiner; and European Patent Application No. 117,355 (Hearn).

As far as the present inventors are aware, none of the foregoing smoking articles or tobacco substitutes have ever realized any commercial success and none have ever been widely marketed. The absence of such smoking articles from the marketplace is believed to be due to a variety of reasons, including insufficient aerosol generation, both initially and over the life of the product, poor taste, off-taste due to thermal degradation of the smoke former and/or flavor agents, the presence of substantial pyrolysis products and sidestream smoke, and unsightly appearance.

Thus, despite decades of interest and effort, there is still no smoking article on the market which provides the benefits and advantages associated with conventional cigarette smoking, without delivering considerable quantities of incomplete combustion and pyrolysis products In late 1985, a series of foreign patents were granted or registered disclosing novel smoking articles capable of providing the benefits and advantages associated with conventional cigarette smoking, without delivering appreciable quantities of incomplete combustion or pyrolysis products. The earliest of these patents was Liberian Patent No. 13985/3890, issued Sept. 13, 1985. This patent corresponds to a later published European Patent Application, Publication No. 174,645, published Mar. 19, 1986.

SUMMARY OF THE INVENTION

The present invention relates to an aerosol producing substrate material for use with a smoking article, and in particular to a porous carrier material having substantially absorbed within its pores a tobacco flavor material and a non-aqueous, non-tobacco aerosol forming material. The present invention also relates to methods of preparing the aerosol producing substrate and, in particular, to a one-step and two-step approach Smoking articles which employ the aerosol producing substrate of the present invention are capable of producing substantial quantities of aerosol, both initially and over the useful life of the product, preferably without significant thermal degradation of the aerosol former and without the presence of substantial pyrolysis or incomplete combustion products or sidestream smoke Such smoking articles provide the user with the sensations and benefits of cigarette smoking without the necessity of burning tobacco.

The present invention provides improved aerosol generation in smoking devices other than conventional cigarettes, cigars and pipes by providing an improved aerosol producing substrate which bears a tobacco flavor material and a non-aqueous, non-tobacco aerosol former material The aerosol producing substrate prepared in accordance with the present invention provides the ability to control both the quantity and characteristics of the aerosol produced during smoking by facilitating uniform application of the tobacco flavor material to the substrate, which in turn, provides improved release of aerosol during smoking of the product without any appreciable undesirable burning or scorching of the tobacco flavor material.

Preferred smoking devices which employ the aerosol producing substrate of the present invention comprise an aerosol generating means which includes the aerosol producing substrate. This combination produces a smoke-like aerosol, having the aroma, flavor, appearance, throat impact and feel of tobacco smoke, but preferably without production of substantial levels of tobacco pyrolysis products. The carrier material employed to prepare the aerosol producing substrate should be porous and should be prepared from a material which is conducive to sorption of the tobacco flavor material and the non-aqueous, non-tobacco aerosol forming material. Preferably, the carrier material is inert to the tobacco flavor material and other aerosol products produced, and is thermally stable at the temperatures encountered during the use of smoking articles employing the aerosol producing substrate. Suitable carrier materials include carbon, alumina, silica, ceramic, vermiculite, clay, and the like. Activated carbon and sintered alumina are preferred carrier materials.

In preferred embodiments, the carrier material is mixed with an admixture or slurry of (i) a tobacco flavor material which may be comminuted tobacco, tobacco extract (either aqueous or organic, e.g., alcohol), spray dried tobacco extract, or the like, and (ii) a non-aqueous, non-tobacco aerosol forming material such as glycerin, propylene glycol, triethylene glycol, and the like. It has been found that the aerosol producing substrate prepared in accordance with the present invention improves the performance of these articles in terms of (a) taste, (b) economy, in the use of materials in the aerosol generating means, (c) the ease of delivering different types of tobacco flavors including blends thereof, (d) the ability to deliver a consistent taste and amount of aerosol, both initially and over the useful life of the product, and (e) reduction of migration of the aerosol forming material and other volatiles to the fuel source and other portions of the smoking article.

The aerosol producing substrate of the present invention may be prepared by a variety of methods, but preferably is prepared using a one-step or two-step approach. In the one-step approach, the tobacco flavor material is preferably mixed with, a non-aqueous, non-tobacco aerosol forming material to form a slurry. The slurry is then applied to a carrier material by mixing, spraying or by similar techniques until the slurry is substantially absorbed by the carrier. In the two-step approach, the tobacco flavor material which is preferably in solid particulate form, e.g. spray dried tobacco extract, is initially mixed with water (or other suitable liquid) to form a slurry. The slurry is then applied to a carrier material as in the one-step approach. The water or other liquid is thereafter substantially removed by appropriate means, e.g. dried in conventional ovens, and the non-aqueous, non-tobacco aerosol forming material is added in a second step. In a variation of the two-step approach, the tobacco flavor material may be applied to the carrier by condensation of a vapor of the tobacco flavor material onto the carrier and thereafter the non-tobacco aerosol forming material added in a second step.

In general, smoking articles utilizing the aerosol producing substrate prepared in accordance with the present invention include (1) a fuel element; (2) a physically separate aerosol generating means including the aerosol producing substrate of the present invention; and (3) an aerosol delivery means such as a longitudinal passageway in the form of a mouth end piece. Preferably the smoking article is of the cigarette type, which utilizes a short, i.e., less than about 30 mm long, preferably carbonaceous, fuel element in conjunction with a physically separate aerosol generating means which utilizes the aerosol producing substrate of the present invention, and which is preferably in a conductive heat exchange relationship with the fuel element.

Preferred smoking articles employing the aerosol producing substrate of the present invention are capable of delivering at least 0.6 mg of aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. The aerosol preferably also has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the term "tobacco flavor material" means those materials which provide a tobacco-type taste, including, but not limited to comminuted tobacco, tobacco extract including aqueous and/or organic extracts, spray dried tobacco extract, and the like.

As used herein, the term "substantially absorbed within" means substantially absorbed within the pores of the carrier material and not substantially on exterior surfaces of the carrier material.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. Suitable insulators have a thermal conductivity in g-cal(sec) ($cm^2$) (°C./cm), of less than about 0.05, preferably less than about 0.02, most preferably less than about 0.005. See, *Hackh's Chemical Dictionary* 34 (4th ed., 1969) and Lange's *Handbook of Chemistry* 10, 272–274 (11th ed., 1973).

The aerosol producing substrate and method of the present invention are described in greater detail in the accompanying drawings and the detailed description of the invention which follow.

DETAILED DESCRIPTION OF THE PREFERRED EMBODIMENTS

Figure 1:
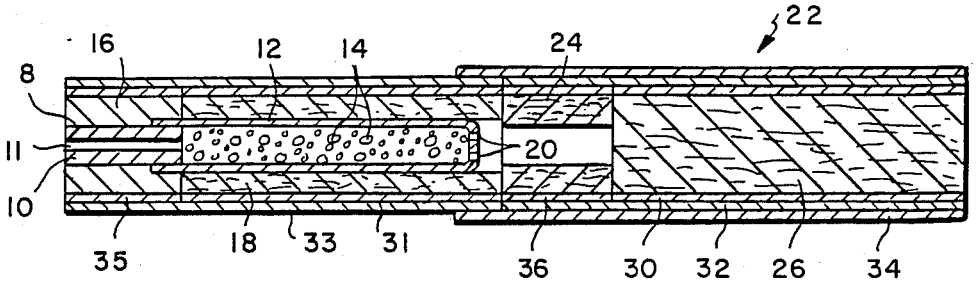
FIG. 1 is a longitudinal view of one preferred smoking article which may employ the aerosol producing substrate of the present invention.

In the one-step approach for producing the aerosol producing substrate of the present invention, a slurry is preferably prepared by admixing a non-aqueous, non-tobacco aerosol former, such as glycerin, propylene glycol, tri-ethylene glycol or mixtures thereof, with a tobacco flavor material such as spray dried tobacco extract, comminuted tobacco, tobacco extract or the like. Spray dried tobacco is preferred. High-shear mixing is preferred, with simultaneous input of heat to reduce the viscosity of the slurry. A preferred machine for mixing these materials is, the Breddo Likwifier (Breddo Food Products, Kansas City, Kans.), model LORWW, 30 horsepower, with jacketed tank section. A sufficient amount of a porous non-tobacco carrier material, such as carbon, activated carbon, alumina or the like is added to the slurry and mixed until the slurry is substantially absorbed within the pores of the carrier material and the resultant aerosol producing substrate is flowable. A medium-shear, low impact mixer is preferred in order to uniformly mix the slurry and carrier with minimal breakage of the carrier material. One such mixer is the Littleford model FM-130-D (Littleford Brothers, Florence, Ky.). When aerosol producing substrate preparation is complete the substrate normally appears dry on the surface, and the aerosol producing substrate is substantially free flowing.

Alternatively, and depending on the viscosity of the particular slurry, the carrier may be sprayed with the slurry using conventional spraying systems. Similarly, other techniques known in the art may be used to apply the slurry to the carrier.

Depending on the non-aqueous, non-tobacco aerosol forming material used, it may be desirable to heat the slurry prior to and/or during mixing with the carrier. The temperature may range broadly depending on the viscosity of the slurry. For example, when the slurry comprises a mixture of glycerin and spray dried tobacco extract, heating the slurry to a temperature of about 400° C. has been found to facilitate absorption of the slurry by the carrier. Excessive temperatures should, however, be avoided in order to prevent thermal decomposition of the slurry components.

As noted above, the preferred tobacco flavor material for the one-step method is spray dried tobacco extract. Spray dried tobacco extract is preferred since, in general, it is desirable to have an aerosol producing substrate with a final water content of less than about 10% by weight, preferably less than about 5% by weight and most preferably less than about 2% by weight.

In the two-step approach, a slurry is prepared in a first step by mixing the tobacco flavor material with water or other suitable liquid such as alcohol. This approach is particularly advantageous when spray dried tobacco extract is used, since spray dried tobacco extract is substantially soluble in water, which, in turn, results in greater absorption by the carrier material. This approach also facilitates ease of application of the slurry to the carrier since the slurry formed is less viscous or sticky.

The amount of spray dried tobacco extract to water may vary broadly depending on the type of spray dried tobacco extract and on the carrier material used to absorb the slurry. For example, for every 25 g of water the amount of spray dried tobacco extract may range from 1.0 g to 16.0 g, preferably from 5.0 g to 12.0 g, and most preferably from 7.0 g to 9.0 g. The spray dried tobacco extract should be mixed with water so as to provide a uniform dispersion, and prevent the formation of lumps. Stirring may be accomplished by a magnetic stirrer or other suitable means.

Alternatively, an aqueous tobacco extract, may be used in lieu of the spray dried/water slurry and applied directly to the carrier, thus eliminating the spray drying step, infra. Any of a number of conventional mixers may be used to mix the slurry with the carrier material. A preferred mixer is the Patterson-Kelly Zig-Zag blender, model CLS (Patterson-Kelly, Inc., East Stroudsburg, Pa.) with the dog-leg style intensifier bar protrusions removed to reduce degradation of the carrier material. Conventional liquid and solid metering controls are preferably used to assure delivery of the desired rates and proportions of the components.

After mixing, the substrate/slurry is dried by appropriate means to reduce the moisture content to less than about 10% by weight. Preferably, the final water content less than about 5% by weight, most preferably less than about 2% by weight. Drying may be achieved in conventional ovens, i.e. convection ovens, at temperatures of about 95° C. or in fluidized bed driers such as an MBD 400 available from Fuji Paudal KK, Japan. Excessively high temperatures, i.e. in excess of about 115° C. for long duration, should be avoided since nicotine and other desirable tobacco flavor components may be driven off at such temperatures.

In the second step, the non-tobacco aerosol forming material and other desired flavors or other additives are added to the carrier containing the dry tobacco flavor material and mixed in a suitable blender such as the Patterson-Kelly Zig-Zag blender described above.

In a variation of the two-step approach, the tobacco flavor material is incorporated into the carrier material in a first step by forming a vapor of the tobacco flavor material and contacting the vapor with the carrier. The tobacco flavor material vapor is allowed to condense on the carrier and the non-tobacco aerosol forming material is added in a second step as described above.

The preferred tobacco flavor material component of the slurry is spray dried tobacco extract. Other tobacco flavor materials include comminuted tobacco, tobacco extract including aqueous and/or organic extracts, freon extract of tobacco, freeze-dried tobacco extract and the like.

The preferred non-aqueous, non-tobacco aerosol forming materials include polyhydric alcohols, or mixtures of polyhydric alcohols. More preferred non-tobacco aerosol formers are selected from glycerin, triethylene glycol and propylene glycol The weight ratio of tobacco flavor material to aerosol forming material prepared either by the one-step or two-step method may vary broadly depending on the tobacco taste desired In general, the weight ratio of tobacco flavor material to aerosol forming material is in the range between about 1:100 and 3:1, preferably between about 1:30 and 2:1, most preferably between about 1:4 and 1:1.

One preferred carrier material is a high surface area alumina, such as a product of W. R. Grace & Co. designated as SMR-14-1896, having a surface area of about 280 $m^2/g$ This alumina (−14 to +20 mesh) is treated to make it suitable for use in the aerosol producing substrate of the present invention by sintering for about one hour at an elevated temperature, e.g., greater than 1000° C., preferably from about 1400° C. to 1550° C., followed by appropriate washing and drying Preferably, the surface area of the treated alumina is less than about 50 $m^2/g$ and the median pore diameter (volume) is greater than about 0.1 microns.

When the above treated alumina is used as the carrier material, the aerosol producing substrate of the present invention prepared either by the one-step or two-step approach generally comprises about 20 to 90 weight percent alumina, about 5 to 50 weight percent non-aqueous, non-tobacco aerosol forming material and about 0.1 to 20 weight percent tobacco flavor material. Preferably, the aerosol producing substrate comprises about 50 to 75 weight percent alumina, about 10 to 30 weight percent non-aqueous, non-tobacco aerosol forming material and about 0.5 to 15 weight percent tobacco flavor material. Most preferably, the aerosol producing substrate comprises about 65 to 70 weight percent alumina, about 15 to 25 weight percent non-aqueous, non-tobacco aerosol forming material and about 7 to 10 weight percent tobacco flavor material.

Other preferred carrier materials include carbons such as PG-60 from Union Carbide and activated carbons such as APC from Calgon Corporation. Such activated carbon materials are preferably treated to make them suitable for use in the aerosol producing substrate of the present invention by heating the material in a non-oxidizing atmosphere for about one hour at an elevated temperature, e.g., greater than 1000° C., preferably greater than 1800° C., and most preferably at about 2500° C. followed by appropriate washing and drying. Preferably, the surface area of the treated activated carbon is less than about 200 $m^2/g$.

When the above treated carbon is used as the carrier material, the aerosol producing substrate of the present invention prepared either by the one-step or two-step approach generally comprises about 15 to 75 weight percent carbon, about 5 to 45 weight percent non-aqueous, non-tobacco aerosol forming material and about 0.1 to 15 weight percent tobacco flavor material. Preferably, the aerosol producing substrate comprises about 40 to 65 weight percent carbon, about 7.5 to 25 weight percent non-aqueous, non-tobacco aerosol forming material and about 0.4 to 1 weight percent tobacco flavor material. Most preferably, the aerosol producing substrate comprises about 55 to 60 weight percent carbon, about 10 to 20 weight percent non-aqueous, non-tobacco aerosol forming material and about 6 to 8.5 weight percent tobacco flavor material.

The aerosol producing substrate may also include one or more additional volatile flavoring agents, such as menthol, vanillin, artificial coffee, tobacco extracts, nicotine, caffeine, liquors, and other agents to impart flavor to the aerosol. There may also be included any other desirable volatile solid or liquid materials. Such optional agents may also or alternatively be added separately to the aerosol generating means or placed between the aerosol generating means and the mouth end, such as in a separate substrate or chamber or coated within the passageway leading to the mouth end, or in an optional tobacco charge which may be employed downstream from the fuel element.

Similarly, various acids or salts thereof may be included in the aerosol producing substrate, e.g. in the slurry, in order to smooth out the taste and physiological effects of the aerosol. Such materials include levulinic acid, caffeic acid, chlorogenic acid, benzoic acid, malic acid, lactic acid, fumaric acid, glucose pentaacetate, sodium octaacetate and the like. The amount of such material by weight percent of the treated substrate may range broadly between 0.5 and 3.0%, preferably between 0.5 and 1.5%, and most preferably about 0.8%. It has been found, for example, that addition of about 1.5% of levulinic acid (including the weight of the substrate) yields a smoke pH approximately equivalent to conventional cigarette smoke.

Advantageously, the aerosol producing substrate of the present invention may be coated with a substance such as graphite, ethyl cellulose, tobacco waxes and the like. Such coatings further reduce migration of aerosol formers, nicotine, flavors, and the like from the aerosol producing substrate to the fuel source. Moreover, such coatings reduce the uptake of moisture and may aid in heat transfer as between the individual particles of the substrate, particularly when the treated substrate is coated with substances such as graphite. Such coatings can be applied by conventional coating processes depending on the particular coating to be applied.

Preferred cigarette-type smoking articles which may employ the modified substrate of the present invention are described in the following patent applications:

| Applicants | Serial No. | Filed |
|---|---|---|
| Sensabaugh et al. | 650,604 | September 14, 1984 |
| Shannon et al. | 684,537 | December 21, 1984 |
| Banerjee et al. | 891,073 | July 28, 1986 |
| Sensabaugh et al. EPO | 85111467.8 | September 11, 1985 (published 3/19/86) |

the disclosures of which are hereby incorporated by reference.

Figure 1A:
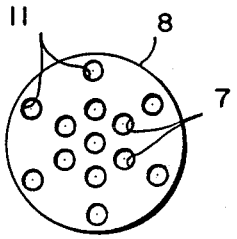
FIG. 1A illustrates, from the lighting end, a preferred fuel element passageway configuration.

One such preferred cigarette-type smoking article is set forth in FIG. 1 accompanying this specification Referring to FIG. 1 there is illustrated a cigarette-type smoking article having a small carbonaceous fuel element 10 with several passageways 11 therethrough, preferably about thirteen arranged as shown in FIG. 1A. This fuel element is formed from an extruded mixture of carbon (preferably from carbonized paper), sodium carboxymethyl cellulose (SCMC) binder, $K_2CO_3$, and water, as described in the above referenced patent applications.

The periphery 8 of fuel element 10 is encircled by a resilient jacket of insulating fibers 16, such as glass fibers.

Overlapping a portion of the mouthend of the fuel element 10 is a metallic capsule 12 which contains a substrate material 14 which at least in part comprises the aerosol producing substrate of the present invention, either in particulate form, or alternatively, in the form of a rod.

Capsule 12 is circumscribed by a jacket of tobacco 18. Two slit-like passageways 20 are provided at the mouth end of the capsule in the center of the crimped tube.

At the mouth end of tobacco jacket 18 is a mouthend piece 22 comprising an annular section of cellulose acetate 24 and a segment of rolled, non-woven polypropylene scrim 26 through which the aerosol passes to the user. The article, or portions thereof, is overwrapped with one or more layers of cigarette papers 30–36.

Upon lighting the aforesaid embodiment, the fuel element burns, generating the heat used to volatilize the tobacco flavor material and any additional aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used.

Because of the small size and burning characteristics of the fuel element, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs. Because the preferred fuel element is so short, there is never a long section of nonburning fuel to act as a heat sink, as was common in some previous thermal aerosol articles.

Because the tobacco flavor material and any additional aerosol forming substances are physically separate from the fuel element, they are exposed to substantially lower temperatures than are generated by the burning fuel, thereby minimizing the possibility of thermal degradation.

In preferred embodiments, the short carbonaceous fuel element, heat conducting member and insulating means cooperate with the aerosol generator to provide a system which is capable of producing substantial quantities of aerosol, on virtually every puff. The close proximity of the fire cone to the aerosol generator after a few puffs, together with the insulating means, results in high heat delivery both during puffing and during the relatively long period of smolder between puffs.

In general, the combustible fuel elements which may be employed in preferred embodiments have a diameter no larger than that of a conventional cigarette (i.e., less than or equal to 8 mm), and are generally less than about 30 mm long. Advantageously the fuel element is about 15 mm or less in length, preferably about 10 mm or less in length. Advantageously,, the diameter of the fuel element is between about 2 to 8 mm, preferably about 4 to 6 mm. The density of the fuel elements employed herein may range from about 0.7 g/cc to about 1.5 g/cc. Preferably the density is greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight may be used especially where a minor amount of tobacco, tobacco extract, or a nonburning inert filler is used.

The aerosol generating means which includes the aerosol producing substrate of the present invention is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

The heat conducting material employed as the container for the aerosol generating means is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve the desired degree of heat transfer.

As shown in the illustrated embodiment, the heat conducting member preferably contacts or overlaps the rear portion of the fuel element, and may form the container or capsule which encloses the aerosol producing substrate of the present invention. Preferably, the heat conducting member extends over no more than about one-half the length of the fuel element. More preferably, the heat conducting member overlaps or otherwise contacts no more than about the rear 5 mm, preferably 2–3 mm, of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members employed in the preferred smoking articles are preferably formed into a resilient jacket from one or more layers of an insulating material. Advantageously, this jacket is at least about 0.5 mm thick, preferably at least about 1 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIG. 1, different materials may be used to insulate these two components of the article.

The currently preferred insulating materials, particularly for the fuel element, are ceramic fibers, such as glass fibers. Preferred glass fiber are experimental materials produced by Owens-Corning of Toledo, Ohio under the designations 6432 and 6437, which have softening points of about 650° C. Other suitable insulating materials, preferably non-combustible inorganic materials, may also be used.

In the most preferred embodiments, the fuel and aerosol generating means will be attached to a mouthend piece, although a mouthend piece may be provided separately, e.g., in the form of a cigarette holder for use with disposable fuel/aerosol generating cartridges. The mouth end piece channels the vaporized aerosol forming substance into the mouth of the user. Due to its length, about 35 to 50 mm, it also keeps the heat from the fire cone away from the mouth and fingers of the user, and provides some cooling of the hot aerosol before it reaches the user.

Suitable mouthend pieces should be inert with respect to the aerosol forming substances, should offer minimum aerosol loss by condensation or filtration, and should be capable of withstanding the temperature at the interface with the other elements of the article. Preferred mouthend pieces include the cellulose acetate-polypropylene scrim combination of FIG. 1 and the mouth end pieces disclosed in Sensabaugh et al., European Patent Publication No. 174,645.

The entire length of the article or any portion thereof may be overwrapped with cigarette paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel element is not restricted. However, papers can be designed to remain wholly or partially intact upon exposure to heat from the burning fuel element. Such papers provide the opportunity to restrict air flow to the burning fuel element, thereby controlling the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., noncombustible mica paper with a plurality of holes therein, may be employed as the overwrap layer. Such a paper controls heat delivery, especially in the middle puffs (i.e., 4–6).

To maximize aerosol delivery, which otherwise could be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 01788 manufactured by Ecusta of Pisgah Forest, N.C., and Kimberly-Clark's P868-16-2 and P878-63-5 papers.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31: 347–364 (1975); Nagao et al., *Mut. Res.*, 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The use of the substrate material of the present invention in cigarette-like smoking articles will be further illustrated with reference to the following examples which will aid in the understanding of the present invention, but which are not to be construed as a limitation thereof. All percentages reported herein, unless otherwise specified, are percent by weight. All temperatures are expressed in degrees Celsius and are uncorrected.

EXAMPLE I

A smoking article of the type illustrated in FIG. 1 was made in the following manner.

A. Fuel Source Preparation

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ (1 wt. percent).

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of up to about 850° C. to remove volatiles.

After cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon: 1 part binder), 1 wt. percent $K_2CO_3$, and sufficient water to make a stiff, dough-like paste.

Fuel elements were extruded from this paste having seven large central holes each about 0.021 in. in diameter and six peripheral holes each about 0.01 in. in diameter. The web thickness or spacing between the inner holes was about 0.008 in. and the average outer web thickness (the spacing between the periphery and hole) was 0.019 in. as shown in FIG. 1A.

These fuel elements were then baked-out under a nitrogen atmosphere at 900° C. for three hours after formation.

B. Spray Dried Extract

Tobacco (Burley, Flue Cured, Turkish, etc.) was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°–230° C. and collecting the dried powder material at the outlet of the drier. The outlet temperature varied from about 82°–90° C.

C. Preparation of Sintered Alumina

High surface area alumina (surface area of about 280 $m^2/g$) from W. R. Grace & Co. (designated SMR-14-1896), having a mesh size of from −8 to +14 (U.S.) was sintered at a soak temperature of about 1400° C. to 1550° C. for about one hour and cooled. The surface area of the modified alumina was approximately 4.0 $m^2/g$. The alumina was washed with water and dried. In a first step, an aqueous solution containing 107 mg of spray dried flue cured tobacco extract was mixed with the sintered alumina (640 mg) and thereafter dried to a moisture content of about 1 weight percent. In a second step, this material was mixed with 233 mg of glycerin and 17 mg of a flavor component obtained from Firmenich, Geneva, Switzerland, under the designation T69-22 until substantially absorbed within the tobacco flavor containing alumina, to produce the aerosol producing substrate of the present invention.

D. Assembly

The capsule used to construct the FIG. 1 smoking article was prepared from deep drawn aluminum. The capsule had an average wall thickness of about 0.004 in. (0.01 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user. About 325 mg of the aerosol producing substrate described above was used to load the capsule. A fuel element prepared as above, was inserted into the open end of the filled capsule to a depth of about 3 mm.

E. Insulating Jacket

The fuel element-capsule combination was overwrapped at the fuel element end with a 10 mm long, glass fiber jacket of Owens-Corning 6437 (having a softening point of about 650° C.), with 3 wt. percent pectin binder, to a diameter of about 7.5 mm. The glass fiber jacket was then overwrapped with Kimberly Clark P878-63-5 paper.

F. Tobacco Jacket

A 7.5 mm diameter tobacco rod (28 mm long) with a 646 plug wrap overwrap (e.g., from a non-filter cigarette) was modified by insertion of a probe to have a longitudinal passageway of about 4.5 mm diameter therein.

G. Assembly

The jacketed fuel element-capsule combination was inserted into the tobacco rod passageway until the glass fiber jacket abutted the tobacco. The glass fiber and tobacco sections were joined together by Kimberly Clark's P850-208 paper (a process scale version of their P878-16-2 paper).

A mouthend piece of the type illustrated in FIG. 1, was constructed by combining two sections; (1) a hollow cylinder of cellulose acetate (10 mm long/7.5 mm outer diameter/4.5 mm inner diameter) overwrapped with 646 plug wrap; and (2) a section of non-woven polypropylene scrim, rolled into a 30 mm long, 7.5 mm diameter cylinder overwrapped with Kimberly-Clark's P850-186-2 paper; with a combining overwrap of Kimberly-Clark's P850-186-2 paper.

The combined mouthend piece section was joined to the jacketed fuel element - capsule section by a final overwrap of RJR Archer Inc. 8-0560-36 tipping with lip release paper.

H. Analyses

Analysis of alumina-type aerosol producing substrate prepared in accordance with the above two-step approach was conducted to determine the uniformity of the glycerin aerosol former, water, and spray dried tobacco extract as measured by nicotine content. Results for nineteen samples showed that the glycerin, water and spray dried tobacco extract content was substantially uniform amongst the samples. The average glycerin content was 22.56 weight percent. The average water content was 0.63 weight percent. The average spray dried tobacco extract content as measured by nicotine content was 0.72 weight percent.

Smoking articles thus prepared produced an aerosol resembling tobacco smoke without any undesirable off-taste due to scorching or thermal decomposition of the aerosol forming material.

EXAMPLE II

A smoking article similar to the smoking article described in Example I was made in the following manner.

A. Fuel Source Preparation

An extruded carbon fuel rod was prepared as described in Section A of Example I. The dry, extruded rod was cut into 10 mm lengths and three centrally spaced 0.5 mm holes were drilled through the length of the rod.

B. Assembly

The metallic containers for the substrate were 30 mm long aluminum tubes having a diameter of about 4.5 mm. One end of each of these tubes was crimped to form an end with a small hole. Approximately 200 mg of the aerosol producing substrate was used to fill each of the containers. The substrate was prepared in accordance with the one-step approach as follows. Glycerin (8.0 grams) was admixed with 4 grams of spray dried tobacco extract prepared as described in Example I to form a slurry. PG-60 granulated carbon (12 grams) was added to the slurry which was then stirred until the aerosol producing substrate was dry to the touch. This mixture afforded a 17 wt. percent tobacco or tobacco extract containing substrate. After the metallic containers were filled, each was joined to a fuel rod by inserting about 2 mm of the fuel rod into the open end of the container. Each of these units was then joined to a 35 mm long polypropylene tube of 4.5 mm internal diameter by inserting one end of the tube over the walled end of the container.

Each of these core units was placed on a sheet of Manniglas 1200 pretreated at about 600° C. for up to about 15 min. in air to eliminate binders, and rolled until the article was approximately the circumference of a cigarette. An additional double wrap of Manniglas 1000 was applied around the Manniglas 1200. The ceramic fiber jacket was cut away from 10 mm of the mouth end of the polypropylene tube so that a 10 mm long annular segment of cellulose acetate filter material could be placed over the polypropylene tube. The mouth end of this segment was heavily coated with conventional glue to block air flow through the filter material. A conventional cellulose acetate filter plug of 10 mm length was butted against the adhesive. The entire unit was then wrapped with ECUSTA 01788 perforated cigarette paper, and a conventional tipping was applied to the mouthend.

EXAMPLE III

Smoking articles were prepared as in Example II, employing the one-step approach except that the substrate material utilized in the aerosol generating means was a specially treated alumina, prepared as follows:

Sintering—High area alumina (surface area=280 $m^2/g$) from W. R. Grace & Co., having a mesh size of from −8 to +14 (U.S.) was treated for use in the articles of this invention by sintering at elevated temperatures as follows. Alumina was rapidly heated to a soak temperature above about 1400° C., preferably from about 1400° to 1550° C., held at the soak temperature for about one hour, followed by rapid cooling, washing and drying.

Loading—Glycerin (4.0 grams) was admixed with 2.5 grams of spray dried tobacco extract (Flue Cured). Dried, sintered alumina (15.0 grams) was added to the slurry and stirred until the alumina was dry to the touch. Approximately 350 mg of such a treated substrate was used to load the metallic capsule.

Analyses—An analysis of alumina substrate mixed with spray dried tobacco extract and glycerin in accordance with the one-step approach was conducted to determine spray dried tobacco extract content as measured by nicotine and glycerin content. Based on ten replicate analyses the average glycerin content was 18.24 weight percent. The average spray dried content as measured by nicotine content was 1.01 weight percent. For comparison purposes an instrument precision study was performed prior to the analysis (chromatographic) of these samples. The instrument precision was 0.2% RSD and 2.2% RSD for nicotine and glycerin, respectively. The samples were prepared by exhaustive (i.e., 4 hr. shaker, 68 hr. passive) isopropanol extraction.

EXAMPLE IV

A smoking article was prepared substantially as in Example I, except that a solid 10 mm long segment (120 mg) of alumina in the form of a rod was used in lieu of the granular alumina. The rod was prepared as follows: an alumina hydrate binder (Catapal SB. Vista Chemical Co., Houston, Tex.) was mixed with alumina from Alcan Chemical Products, Cleveland, Ohio (designated C-71-UNG) at a ratio of 60:40. Mixing was done in a roller mill for 4 hours. Peptizing of alumina was achieved by acetic acid treatment. In a muller the alumina hydrate and alumina substrate were mixed with aqueous 5% acetic acid to a 31% moisture content. The mix was held for 4 hours at room temperature in an airtight container. The mix was extruded in thin strands of various diameters in a ram extruder using a Forney compression tester. The extrudates were dried at room temperature and heated at a chamber temperature of 500° C. for 3 hours. Heating was done in less than one inch bed depth. The 500° C.-sintered material was further modified by sintering at 1300° C. for 1 hour to convert the alumina from its gamma to its alpha form. The rod was then treated in accordance with the two-step method. The treated rod contained 19.4 mg of spray dried tobacco dried to about 4% moisture content and 46 mg of glycerin (added in the second step).

EXAMPLE V

Preferred cigarette-type smoking articles of the type illustrated in FIG. 1 employing the aerosol producing substrate of the present invention were prepared substantially as described in Example I:

The carrier material for the aerosol generating means was a high surface area alumina (surface area=280 $m^2/g$), having a mesh size of from −14, +20 (U.S.). Before use herein, this alumina was sintered for about 1 hour at a soak temperature from about 1400° to 1550° C. After cooling, this alumina was washed with water and dried.

This sintered alumina was combined, in a two step process, with the ingredients shown in Table I in the indicated proportions:

TABLE I

| | |
|---|---|
| Alumina | 67.7% |
| Glycerin | 19.0% |
| Spray Dried Extract | 8.5% |
| Flavoring Mixture | 4.2% |
| Glucose pentaacetate | 0.6% |
| Total: | 100.0% |

The spray dried extract is the dry powder residue resulting from the evaporation of an aqueous tobacco extract solution. It contains water soluble tobacco components. The flavoring mixture is a mixture of flavor compounds which simulates the taste of cigarette smoke. One such material used herein was obtained from Firmenich of Geneva, Switzerland under the designation T69-22.

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 wt. percent. In the second step, this treated alumina was mixed with a combination of the other listed ingredients until the liquid was substantially absorbed within the alumina carrier. The capsule was filled with about 325 mg of this substrate material.

What is claimed is:

1. A method of preparing an aerosol producing substrate material for use with smoking articles, said method comprising the steps of:

(a) forming a slurry of a tobacco flavor material and a non-aqueous, non-tobacco aerosol forming material; and (b) applying the slurry to a porous non-tobacco carrier, the slurry being substantially absorbed within the carrier.

2. The method of claim 1, wherein the porous non-tobacco carrier comprises particulate material.

3. The method of claim 2, wherein absorption of the slurry by the porous non-tobacco carrier is sufficient to produce a free flowing substrate.

4. The method of claim 1, wherein the weight ratio of tobacco flavor material to non-tobacco aerosol forming material is in the range between about 1:100 and about 3:1.

5. The method of claim 4, wherein the weight ratio of tobacco flavor material to non-tobacco aerosol forming material is in the range between about 1:30 and about 2:1.

6. The method of claim 4, wherein the weight ratio of tobacco flavor material to non-tobacco aerosol forming material is in the range between about 1:4 and about 1:1.

7. The method of claim 1, 2, 3, 4, 5 or 6, wherein the tobacco flavor material is selected from the group of comminuted tobacco, tobacco extract, spray dried tobacco extract, or mixtures thereof.

8. The method of claim 1, 2, 3, 4, 5 or 6, wherein the non-tobacco aerosol forming material is selected from the group of glycerin, triethylene glycol, propylene glycol, or mixtures thereof.

9. The method of claim 1, 2, 3, 4, 5 or 6, wherein the porous non-tobacco carrier is selected from the group consisting of carbon, alumina, silica, ceramic, vermiculite, clay, or mixtures thereof.

10. The method of claim 9, wherein the carrier is alumina.

11. The method of claim 10, wherein the alumina is sintered alumina.

12. The method of claim 11, wherein the surface area of alumina is less than about 50 $m^2/g$ and the median pore diameter is greater than about 0.1 microns.

13. The method of claim 12, wherein the aerosol producing substrate comprises about 20 to 90 weight percent alumina, about 5 to 50 weight percent non-tobacco aerosol forming material and about 0.1 to 20 weight percent tobacco flavor material.

14. The method of claim 12, wherein the aerosol producing substrate comprises about 50 to 75 weight percent alumina, about 10 to 30 weight percent non-tobacco aerosol forming material and about 0.5 to 15 weight percent tobacco flavor material.

15. The method of claim 12, wherein the aerosol producing substrate comprises about 65 to 70 weight percent alumina, about 15 to 25 weight percent non-tobacco aerosol forming material and about 7 to 10 weight percent tobacco flavor material.

16. The method of claim 9, wherein the carrier is carbon.

17. The method of claim 16, wherein the carbon is activated carbon.

18. The method of claim 16, wherein the surface area of the carbon is less than about 200 $m^2/g$.

19. The method of claim 18, wherein the aerosol producing substrate comprises about 15 to 75 weight percent carbon, about 5 to 45 weight percent non-tobacco aerosol forming material and about 0.1 to 15 weight percent tobacco flavor material.

20. The method of claim 18, wherein the aerosol producing substrate comprises about 40 to 65 weight percent carbon, about 7.5 to 25 weight percent non-tobacco aerosol forming material and about 0.4 to 13 weight percent tobacco flavor material.

21. The method of claim 18, wherein the aerosol producing substrate comprises about 55 to 60 weight percent carbon, about 10 to 20 weight percent non-tobacco aerosol forming material to about 6 and 8.5 weight percent tobacco flavor material.

22. A method of preparing an aerosol producing substrate material for use with smoking articles, said method comprising the steps of:

(a) forming a slurry of a tobacco flavor material and water;

(b) applying the slurry to a carrier material;

(c) reducing the water content of the resulting material to less than about 10% by weight; and (d) adding a non-aqueous, non-tobacco aerosol forming material to the carrier material, the non-aqueous, non-tobacco aerosol forming material being substantially absorbed within the carrier material.

23. The method of claim 22, wherein the carrier material is a porous non-tobacco carrier.

24. The method of claim 22, wherein the carrier comprises particulate material.

25. The method of claim 22, wherein absorption of the non-tobacco aerosol forming material by the carrier is sufficient to produce a free flowing substrate.

26. The method of claim 22, wherein the weight ratio of tobacco flavor material to non-tobacco aerosol forming material is in the range between about 1:100 and about 3:1.

27. The method of claim 26, wherein the weight ratio of tobacco flavor material to non-tobacco aerosol forming material is in the range between about 1:30 and about 2:1.

28. The method of claim 26, wherein the weight ratio of tobacco flavor material to non-tobacco aerosol forming material is in the range between about 4:1 and about 1:1.

29. The method of claim 22, 23, 24, 25, 26, 27 or 28, wherein the tobacco flavor material is selected from the group of comminuted tobacco, tobacco extract, spray dried tobacco extract or mixtures thereof

30. The method of claim 22, 23, 24, 25, 26, 27 or 28, wherein the non-tobacco aerosol forming material is selected from the group of glycerin, triethylene glycol, propylene glycol or mixtures thereof.

31. The method of claim 22, 23, 24, 25, 26, 27 or 28, wherein the carrier is selected from the group consisting of carbon, alumina, silica, ceramic, vermiculite, clay, or mixtures thereof.

32. The method of claim 31, wherein the carrier is alumina.

33. The method of claim 32, wherein the alumina is sintered alumina.

34. The method of claim 33, wherein the surface area of alumina is less than about 50 $m^2/g$ and the median pore diameter greater than about 0.1 microns.

35. The method of claim 34, wherein the aerosol producing substrate comprises about 20 to 90 weight percent alumina, about 5 to 50 weight percent non-tobacco aerosol forming material and about 0.1 to 20 weight percent tobacco flavor material.

36. The method of claim 34, wherein the aerosol producing substrate comprises about 50 to 75 weight percent alumina, about 10 to 30 weight percent non-tobacco aerosol forming material and about 0.5 to 15 weight percent tobacco flavor material.

37. The method of claim 34, wherein the aerosol producing substrate for comprises about 65 to 70 weight percent alumina, about 15 to 25 weight percent non-tobacco aerosol forming material and about 7 to 10 weight percent tobacco flavor material.

38. The method of claim 31, wherein the carrier is carbon.

39. The method of claim 38, wherein the carbon is activated carbon.

40. The method of claim 38, wherein the surface area of carbon is less than about 200 $m^2/g$.

41. The method of claim 40, wherein the aerosol producing substrate comprises about 15 to 75 weight percent carbon, about 5 to 45 weight percent non-tobacco aerosol forming material and about 0.1 to 15 weight percent tobacco flavor material.

42. The method of claim 40, wherein the aerosol producing substrate comprises about 40 to 65 weight percent carbon, about 7.5 to 25 weight percent non-tobacco aerosol forming material and about 0.4 to 13 weight percent tobacco flavor material.

43. The method of claim 40, wherein the aerosol producing substrate comprises about 55 to 60 weight percent carbon, about 10 to 20 weight percent non-tobacco aerosol forming material and about 6 to 8.5 weight percent tobacco flavor material.

44. The aerosol producing substrate prepared by the method of claim 1, 2, 3, 4, 5, 6, 22, 23, 24, 25, 26 or 27.

45. A method of preparing an aerosol producing substrate for subsequent use with smoking articles, said method comprising the steps of:

(a) forming a vapor of a tobacco flavor material; and (b) condensing said vapor on a carrier material.

46. The method of claim 45, further comprising the step of adding a non-aqueous, non-tobacco aerosol forming material to said carrier.

47. An aerosol producing substrate for use with a smoking article comprising a porous alumina material having substantially absorbed within its pores a tobacco flavor material and a non-aqueous, non-tobacco aerosol forming material.

48. The aerosol producing substrate of claim 47, wherein the carrier comprises particulate material.

49. The aerosol producing substrate of claim 48, wherein the substrate is dry and free flowing.

50. The aerosol producing substrate of claim 47, wherein the weight ratio of tobacco flavor material to non-tobacco aerosol forming material is in the range between about 1:100 and about 3:1.

51. The aerosol producing substrate of claim 50, wherein the weight ratio of tobacco flavor material to non-tobacco aerosol forming material is in the range between about 1:30 and about 2:1.

52. The aerosol producing substrate of claim 50, wherein the weight ratio of tobacco flavor material to non-tobacco aerosol forming material is in the range between about 1:4 and about 1:1.

53. The aerosol producing substrate of claim 47, 48, 49, 50, 51 or 52, wherein the tobacco flavor material is selected from the group of comminuted tobacco, tobacco extract, spray dried tobacco extract and mixtures thereof.

54. The aerosol producing substrate of claim 47, 48, 49, 50, 51 or 52, wherein said non-tobacco aerosol forming material is selected from the group of glycerin, triethylene glycol, propylene glycol or mixtures thereof.

55. The aerosol producing substrate of claim 47, 48, 49, 50, 51 or 52, wherein the alumina is sintered alumina.

56. The aerosol producing substrate of claim 55, wherein the surface area of alumina is less than about 50 $m^2/g$ and the median pore diameter greater than about 0.1 microns.

57. The aerosol producing substrate of claim 56, wherein the aerosol producing substrate comprises about 20 to 90 weight percent alumina, about 5 to 50 weight percent non-tobacco aerosol forming material and about 0.1 to 20 weight percent tobacco flavor material.

58. The aerosol producing substrate of claim 56, wherein the aerosol producing substrate comprises about 50 to 75 weight percent alumina, about 10 to 30 weight percent non-tobacco aerosol forming material and about 0.5 to 15 weight percent tobacco flavor material.

59. The aerosol producing substrate claim 56, wherein the aerosol producing substrate comprises about 65 to 70 weight percent alumina, about 15 to 25 weight percent non-tobacco aerosol forming material and about 7 to 10 weight percent tobacco flavor material.

60. An aerosol producing substrate for use with a smoking article, said aerosol producing substrate comprising a porous carbon carrier having substantially absorbed within its pores a tobacco flavor material and a non-aqueous non-tobacco aerosol forming material.

61. The aerosol producing substrate claim 60, wherein the carrier comprises particulate material.

62. The aerosol producing substrate claim 60, wherein the substrate is free flowing.

63. The aerosol producing substrate of claim 60, wherein the weight ratio of tobacco flavor material to non-tobacco aerosol forming material is in the range between about 1:100 and about 3:1.

64. The aerosol producing substrate of claim 63, wherein the weight ratio of tobacco flavor material to non-tobacco aerosol forming material is in the range between about 1:30 and about 2:1.

65. The aerosol producing substrate, of claim 63, wherein the weight ratio of tobacco flavor material to non-tobacco aerosol forming material is in the range between about 1:4 and about 1:1.

66. The aerosol producing substrate claim 60, 61, 62, 63, 64 or 65, wherein the tobacco flavor material is selected from the group of comminuted tobacco, tobacco extract, spray dried tobacco extract and mixtures thereof.

67. The aerosol producing substrate claim 60, 61, 62, 63, 64 or 65, wherein said non-tobacco aerosol forming material is selected from the group of glycerin, triethylene glycol, propylene glycol or mixtures thereof.

68. The aerosol producing substrate claim 60, 61, 62, 63, 64 or 65, wherein the carbon is activated carbon.

69. The aerosol producing substrate claim 60, 61, 62, 63, 64 or 65, wherein the carbon comprises particles having a surface area less than about 200 $m^2/g$.

70. The aerosol producing substrate claim 69, wherein the aerosol producing substrate comprises about 15 to 75 weight percent carbon, about 5 to 45 weight percent non-tobacco aerosol forming material and about 0.1 to 15 weight percent tobacco flavor material.

71. The aerosol producing substrate claim 69, wherein the aerosol producing substrate comprises about 40 to 65 weight percent carbon, about 7.5 to 25 weight percent non-tobacco aerosol forming material and about 0.4 to 13 weight percent tobacco flavor material.

72. The aerosol producing substrate claim 69, wherein the aerosol producing substrate about 55 to 60 weight percent carbon, about 10 to 20 weight percent non-tobacco aerosol forming material and about 6 to 8.5 weight percent tobacco flavor material.

* * * * *

UNITED STATES PATENT AND TRADEMARK OFFICE

CERTIFICATE OF CORRECTION

PATENT NO. : 4,858,630

DATED : August 22, 1989

INVENTOR(S) : Chandra K. Banerjee and Gary R. Shelar

It is certified that error appears in the above—identified patent and that said Letters Patent is hereby corrected as shown below:

Abstract, line 9, "present" should be --presence--.

Col. 7, line 23, "1" should be --13--.

Signed and Sealed this

Second Day of April, 1991

*Attest:*

HARRY F. MANBECK, JR.

*Attesting Officer*

*Commissioner of Patents and Trademarks*